US007097390B1

(12) United States Patent
Moss

(10) Patent No.: US 7,097,390 B1
(45) Date of Patent: Aug. 29, 2006

(54) FINE-GRAINED FILL REINFORCING APPARATUS AND METHOD

(75) Inventor: Arthur L. Moss, Logan, UT (US)

(73) Assignee: Mega, Inc., Logan, UT (US)

( * ) Notice: Subject to any disclaimer, the term of this patent is extended or adjusted under 35 U.S.C. 154(b) by 0 days.

(21) Appl. No.: 11/155,143

(22) Filed: Jun. 16, 2005

(51) Int. Cl.
*E02D 3/00* (2006.01)
*E02D 29/02* (2006.01)

(52) U.S. Cl. ..... 405/302.7; 405/284; 405/302.4; 405/262

(58) Field of Classification Search ..... 405/262, 405/284–286, 302.4, 302.7
See application file for complete search history.

(56) References Cited

U.S. PATENT DOCUMENTS

| | | | | |
|---|---|---|---|---|
| 3,957,098 | A * | 5/1976 | Hepworth et al. | 383/45 |
| 5,139,369 | A * | 8/1992 | Jaecklin | 405/262 |
| 5,553,972 | A | 9/1996 | Bergeron et al. | |
| 5,669,732 | A * | 9/1997 | Truitt | 405/20 |
| 5,697,736 | A | 12/1997 | Veazey et al. | |
| 5,800,095 | A | 9/1998 | Egan | |
| 5,816,749 | A | 10/1998 | Bailey, II | |
| 5,902,070 | A * | 5/1999 | Bradley | 405/21 |
| 5,911,539 | A | 6/1999 | Egan et al. | |
| 5,934,027 | A * | 8/1999 | Khalili | 52/167.1 |
| 6,056,438 | A * | 5/2000 | Bradley | 383/66 |
| 6,056,479 | A | 5/2000 | Stevenson et al. | |
| 6,481,928 | B1 * | 11/2002 | Doolaege | 405/115 |
| 6,494,009 | B1 * | 12/2002 | Kang | 405/285 |
| 6,623,214 | B1 | 9/2003 | Hauske et al. | |
| 6,626,611 | B1 | 9/2003 | Winters et al. | |
| 6,641,329 | B1 * | 11/2003 | Clement | 405/115 |
| 6,736,568 | B1 | 5/2004 | Pugh et al. | |
| 6,905,289 | B1 * | 6/2005 | Sanguinetti | 405/302.6 |
| 2002/0021944 | A1 | 2/2002 | Winters et al. | |
| 2005/0005566 | A1 * | 1/2005 | Kim | 52/719 |

FOREIGN PATENT DOCUMENTS

| | | | |
|---|---|---|---|
| JP | 04118419 A | * | 4/1992 |
| JP | 08020950 A | * | 1/1996 |
| WO | WO 03/064774 | * | 8/2003 |

OTHER PUBLICATIONS

Terram, "Reinforced Slopes," http://www.terram.com/reinforcement.html, Apr. 20, 2005, pp. 1-4.

(Continued)

*Primary Examiner*—Frederick L. Lagman
(74) *Attorney, Agent, or Firm*—Pate Pierce & Baird

(57) ABSTRACT

A geosynthetic reinforcement comprising a container formed of semipermeable material mutually conformed with a portion of earthen material contained therein. A structural member such as a geogrid may engage (e.g. frictional) the container and extend therefrom to engage and support a structure such as a retaining wall, earthen slope, etc. Accordingly, the container may function as an anchor to the structure. Due to the containment provided by the container, the physical characteristics of the earthen material therewithin become less important. Thus, low quality fills such as fine-grained fill or fill with a high moisture content may be used in structural applications. If desired, more than one container and structural member may be incorporated. Containers may be stacked, positioned side-by-side, positioned end-to-end, etc. Structural members may be incorporated as needed to adequate support the structure. Drain layers may be incorporated to control moisture. In some cases, containers may comprise geotextile tubes.

20 Claims, 13 Drawing Sheets

OTHER PUBLICATIONS

Ace Geosynthetics, "Geogrid Application," http://www.geoace.com/application_geogrid_ex.htm, Apr. 20, 2005, pp. 1-5.
James P. Sale et al., "Membrane Encapsulated Soil Layes," http://www.pubs.asce.org/WWWdisplay.cgi?7300233, Apr. 20, 2005, pp. 1-2.
Tenax, "Drainage of road bases," http://www.tenax.net/geosynthetics/drainage/road_bases.htm, Feb. 24, 2005, pp. 1-2.
Tensar Earth Technologies, Inc., "Mesa Retaining Wall Systems," http://www.tensarcorp.com/index.asp?id=100, Feb. 24, 2005, pp. 1-2.
Druxel University, Geosynthetic Applications, http://www.drexel.edu/gri/geomat.html, Feb. 25, 2005, pp. 1-11.
C. Joel Sprague et al., "Dredged-material filled geotextile tubes: design and construction," GFR's Designer's Forum, 2003, pp. 114-118.
Douglas A. Gaffney, "Geotextile tube dewatering: Part 1—design parameters," GFR's Designer's Forum, 2003, pp. 119-122.
Douglas A. Gaffney, "Geotextile Tube Dewarting-Part 2: successful project implementation," GFR's Designer's Forum, 2003, pp. 123-126.
Anthony Bradley, "Geotextile tubes; a manufacturer's perspective," GFR's Designer's Forum, 2003, pp. 127-129.
Bradley Industrial Textiles, Inc., "Phoenix Spiral Geotextile Tubes," GFR 2004 Specificer's Guide, Dec. 2003, p. 9.
Jeffrey A Stark et al., "Expedient MESL Construction in cold weather," US Army Corps of Engineers, Jul. 2000, pp. 1-23, Hanover, New Hampshire.
Terram, "Reinforced Slopes," Terram, Mamhilad, UK, date unknown, pp. 1-12.
Mirafi, "Geosynthetics," date unknown, pp. 1-16.
Bob Barret et al., "Geotextile-reinforced retaining walls using granular backfills," GFR's Designer's Forum, date unknown, pp. 168-172.
Mark Wayne et al., "On-site soil usage with geogrid reinforced SRWs," GFR's Designer's Forum, date unknown, pp. 184-189.

* cited by examiner

FINE-GRAINED FILL REINFORCING APPARATUS AND METHOD

BACKGROUND

1. The Field of the Invention

This invention relates to geosynthetic reinforcements for reinforced earthwork construction and, more particularly, to novel systems and methods for using fine-grained fill in structural applications.

2. The Background Art

In general, earthen fills may be divided into two groups, namely granular and fine-grained. Granular fill such as gravel, coarse sand, fine sand, and the like is sometimes referred to as cohesionless fill. Granular fill has an inherent ability to resist shear loads. Fine-grained fill, on the other hand, is often referred to as cohesive fill because it is held together primarily by cohesion between particles. Fine-grain fill has low particle-to-particle frictional interaction and thus, little inherent ability to resist shear loads. Examples of fine-grained fill include silt and clay.

Fine-grained fill is typically not included in the design and construction of geosynthetic reinforcements (e.g. retaining walls, berms, breakers, road beds, causeways, etc.) because of its low shear strength and the potential for settlement, slope failure, bulging failure, and creep. Fine-grained fill is particularly avoided in geosynthetic reinforcements that will be exposed to excess water.

For example, the amount of fine-grained fill currently tolerated behind modern reinforced retaining walls is strictly limited. In recent years, conventional concrete, gravity, and cantilever retaining wall designs have been rendered obsolete by geosynthetics and other materials used to reinforce the fill located behind retaining walls. Retaining walls reinforced with geosynthetics are significantly cheaper to construct, support greater heights on poorer quality foundations, and appear to have greater seismic stability.

Current retaining walls reinforced with geosynthetics require fill containing significant amounts of granular material. This granular component increases the shear strength of the fill to the point where it can engage and retain the geosynthetic reinforcements. In its specified retaining wall designs, the National Concrete Masonry Association (NCMA) limits the percentage of fines (earthen particles sufficiently small to pass through a number two hundred sieve) within backfill to fifteen percent by weight. The American Association of State Highway and Transportation Officials (AASHTO) limits the percentage of fines within similar backfill to twenty-five percent by weight.

In general, granular fill is more expensive than fine-grained fill. Additionally, in certain locations, the availability of fine-grained fill far exceeds that of granular fill. When granular fill is needed in such locations, it must be transported. The cost associated with such transportation may be high, and occasionally prohibitive. Accordingly, what is needed is an apparatus and method supporting the use of fine-grained or high-moisture-containing fill in geosynthetic reinforcements such as retaining walls, berms, breakers, roadbeds, causeways, and the like.

BRIEF SUMMARY OF THE INVENTION

In view of the foregoing, in accordance with the invention as embodied and broadly described herein, an apparatus and method are disclosed in one embodiment of the present invention to permit the use of an alternative or cheaper soil such as fine-grained fill to construct geosynthetic reinforced structures or reinforcements such as retaining walls, berms, breakers, road beds, causeways, and the like.

In selected embodiments, a geosynthetic reinforcement in accordance with the present invention may include one or more containers or enclosures formed of semipermeable material. Each container may conformally contain a portion of earthen material. One or more structural members may engage the containers or some subset thereof. The structural members may transfer loads applied thereto to the corresponding containers. In such embodiments, a container may act as an anchor for the structural member. Accordingly, the structural member may extend from the container to engage and support a structure such as a retaining wall, earthen slope, etc. Suitable structural members may include geotextiles, geogrids, and the like.

In operation, the containers may confine, strengthen, and drain the earthen material contained therein. If desired or necessary, drain layers may be placed underneath and between the various containers. The drain layers may accelerate evacuation of any water held within the containers. Suitable drain layers may include sand, gravel, conduits, geogrids, geonets, specially designed geocomposite drains, or combinations thereof.

Containers used in a geosynthetic reinforcement in accordance with the present invention may be stacked, positioned end-to-end, positioned side-by-side, crossed, or some combination thereof. In certain embodiments, structural members and drain layers may be placed at the interface of selected containers. For example, in one embodiment, a first container may be stacked on top of a second container. A drain layer and structural member may be placed between the two containers. The structural member may then extend from this interface to engage and support a structure (e.g. retaining wall, etc.).

The engagement between and a structural member and a container may be designed to support any anticipated loadings. In some embodiments, the engagement between a structural member and a corresponding container may be frictional (i.e. based on micro-mechanical interference or gripping between the material of the structural member and the material of the container).

The use of containers or enclosures permit the use of formerly undesirable or unusable fills (e.g. fine-grained or high-moisture-containing fill) in structural applications. As noted hereinabove, decreasing granularity or increasing moisture content within a fill produces lower friction angles, lower shear strengths, higher lateral earth pressures, and flatter failure surfaces. At some point in this continuum, the fill is no longer able to engage and retain a structural member with sufficient strength. However, the present invention takes advantage of the structural integrity of the geosynthetic container or enclosure to produce the shear strength previously provided by granular fill. That is, by placing the fine-grained or high moisture content fill within a container or enclosure, a structural member may engage the container, rather than the fill itself. Accordingly, the present invention permits the use of fine-grained fills having little to no shear strength.

By permitting the use of fine-grained fill, the need for expensive granular fill may be significantly reduced. Additionally, in selected locations, fine-grained fill is readily available, but granular fill is not. Accordingly, the present invention may significantly reduce transportation costs. Moreover, in some cases, containers in accordance with the present invention may be filled with a dredge, rather than traditional methods of backfilling requiring the use of heavy construction equipment for earth movement and compaction. As a result, fewer construction workers are needed, construction schedules may be accelerated, and the heavy equipment may be freed for use elsewhere.

In selected embodiments, a geosynthetic reinforcement in accordance with the present invention may include one or more containers formed as geotextile tubes. The materials used to manufacture such tubes provide significant flexibility to accommodate the settlements expected during dewatering of fine-grained fill. These materials are also chemically stable in a wide range of underground environments. Accordingly, geotextile tubes or structures are capable of retaining soft, fine-grained fill or dredge material and providing a building block of significant structural integrity.

Geotextile tubes provide other advantages as well. For example, geotextile tubes are available from a number of manufacturers worldwide. Construction using such tubes does not require specialized equipment or expertise. Moreover, by only partially filling a geotextile tube, the geotextile walls are not loaded to full capacity. Accordingly, the strength requirements of both the geotextile and seams may be significantly reduced, which translates to lower manufacturing costs.

Geosynthetic reinforcements in accordance with the present invention may be used in a number of applications. For example, reinforcements may provide storage of contaminated earthen materials. This storage can be temporary or permanent. In some embodiments, filled containers may be incorporated into a site plan (e.g. used to build containment berms). In such applications, chemicals may be added when filling the containers to rectify or strengthen a waste material.

Geosynthetic reinforcements in accordance with the present invention may provide a quick-assembling flood-control dike. For example, several containers may be stacked and protected by a plastic barrier to make the reinforcement water resistant. Additionally, due to their ability to quickly drain, such reinforcements may be installed during inclement weather. Such a reinforcement may protect greater areas in shorter periods of time than may be possible with conventional sandbags.

Geosynthetic reinforcements in accordance with the present invention may provide a quick-assembling section for a failed roadway. For example, by positioning one or more containers filled with fine sand, a substantial portion of a failed slope may be replaced. Moreover, the reinforcement may sufficiently improve drainage and containment to prevent a recurrence. Once the construction surface is close to original grade, conventional equipment may backfill to the final grade and repave the road. In such applications, much of the repair can be effected without heavy equipment, whose use is severely limited in such inclement conditions.

Additionally, geosynthetic reinforcements in accordance with the present invention may be used in environmentally sensitive areas such as wetlands. Reinforcements may bridge over soft foundations. They may be constructed without the extensive use of heavy equipment and without removing vegetation or water. Furthermore, the impact of such reinforcements may be limited as water exiting a container is filtered by the material forming the container.

Moreover, the use of multiple containers or structures permits higher embankment heights and widths. Structural members anchored to the containers may support facing materials, which protect the structure as well as strengthening the roadway during construction. In such applications, additives (e.g. cement, sand) may be introduced while filling the containers to control final structural properties. If desired, the initial layer of geotextile tubes or containers can be left unamended to allow sufficient flexibility to settle with the underlying soft foundation.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
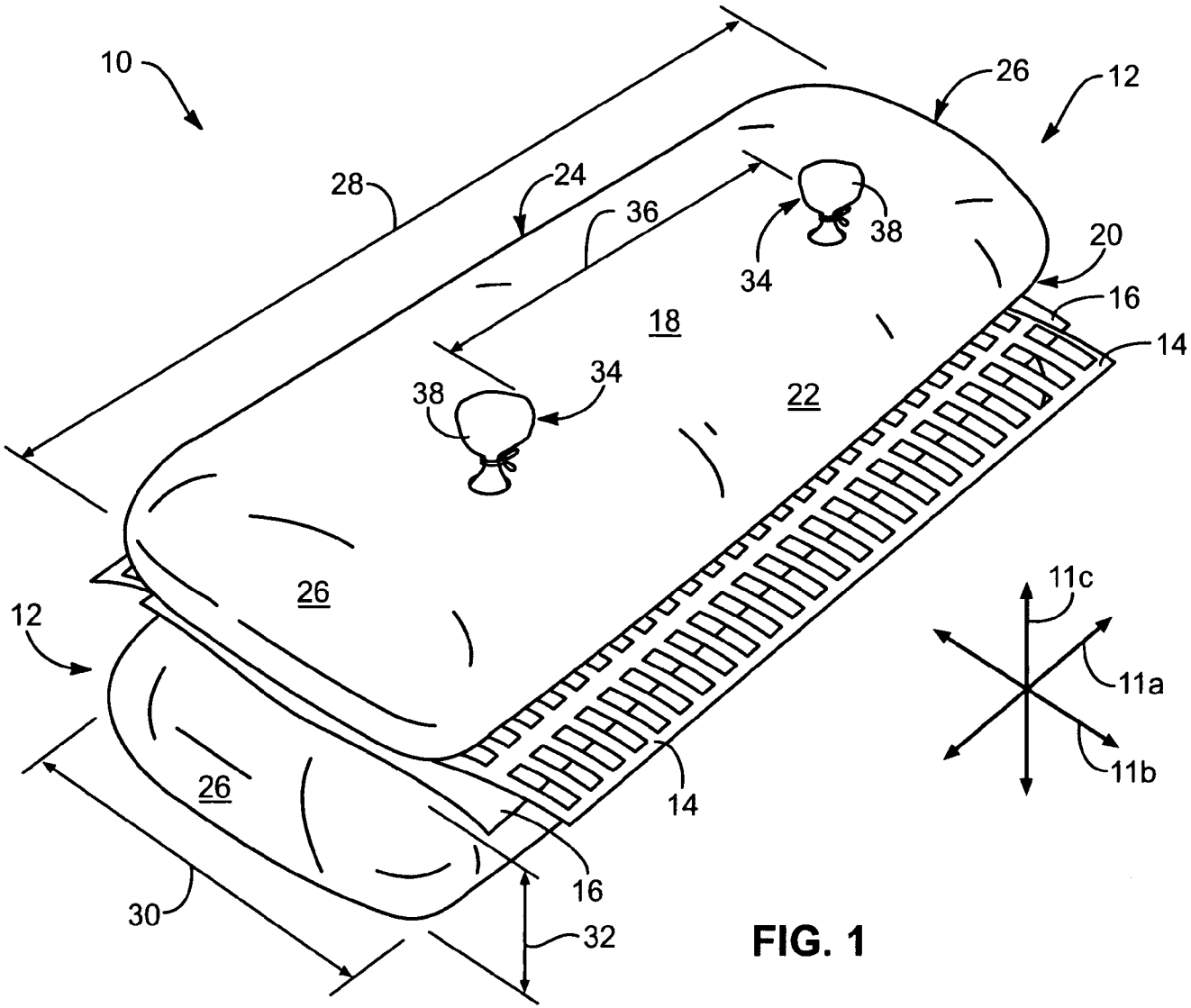
FIG. 1 is a perspective view of a geosynthetic reinforcement structure in accordance with the present invention comprising two stacked, fully enclosed containers, each filled with earthen material, with a structural member and a drain layer positioned therebetween.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a geosynthetic reinforcement 10 in accordance with the present invention may define longitudinal 11*a*, lateral 11*b*, and transverse directions 11*c* substantially orthogonal to one another. In selected embodiments, a geosynthetic reinforcement 10 may include one or more containers 12, one or more structural members 14, and one or more drain layers 16. In operation, a container 12 may act as an anchor to a structural member 14. Accordingly, selected loads (e.g. tensile loads) applied to the structural member 14 may be transferred to the container 12, where they may be resolved and resisted.

To increase the anchoring ability of a container 12, it may be filled to a selected percentage of its capacity with an earthen material. In some embodiments, the container 12 may conform to the shape of the earthen material. In other embodiments, the earthen material may conform to the shape of the container 12. In still other embodiments, the container 12 and earthen material may each conform in some degree to the other.

A structural member 14 may engage a container 12 in any suitable manner. In some embodiments, suitable engagements may include welding, bonding, glueing, sewing, riveting, bolting, and the like. In other embodiments, the weight of the container 12 may provide a frictional engagement with a structural member 14 positioned therebelow. This frictional engagement or micro-mechanical gripping may be sufficient to accommodate any loadings that may be applied to the structural member 14.

A structural member 14 may engage a container 12 at any suitable location. For example, in selected embodiments, a structural member 14 may comprise a substantially continuous sheet or combination of sheets. Such a sheet or combination of sheets may be engage a container 14 on its top 18, bottom 20, front side 22, back side 24, ends 26, or some combination thereof. In other embodiments, multiple structural members 14 may be distributed along the length 28 of the container. Accordingly, the structural members 14 may periodically engage any portion 18, 20, 22, 24, 26 of the container 12.

In still other embodiments, a structural member 14 may loop completely or partially around the container 12. For example, a structural member 14 may begin near the front side 22 and bottom 20 portion of the container 12 and pass below the container 12, up the back side 24, and over the top 18 to return to the front side 22. Such looping may be periodic or substantially continuous along the length 28 of the container 12.

A container 12 in accordance with the present invention may have any suitable length 28, width 30, and height 32. In selected embodiments, the dimensions 28, 30, 32 of a container 12 may be selected to provide the weight necessary to properly anchor any structural member 14 relying thereon. The dimensions 28, 30, 32 may also be selected according to the characteristics of the geosynthetic reinforcement 10. In certain embodiments, the characteristics of the geosynthetic reinforcement 10 may demand volume that cannot practically be provided in a single container 12. In such cases, multiple containers 12 may be used. For example, if additional height 32 is needed, containers 12 may be stacked to support one another. If additional length 28 is needed, containers 12 may be positioned end-to-end.

Containers 12 in accordance with the present invention may have any suitable shape. For example, in selected embodiments, a container 12 may be substantially tubular. Accordingly, in some embodiments, a container 12 may comprise a geotextile tube 12. In general, geotextile tubes 12 are manufactured from high strength polyester or polypropylene. Standard geotextile tubes 12 range from fifteen to thirty-five feet in circumference. However, they may be fabricated to any desired diameter by sewing or otherwise connecting various widths of a geotextile. The length 28 of a geotextile tube 12 may be selected to meet the requirements of the specific geosynthetic reinforcement 10. The length 28 may extend up to several hundred feet and is, in general, only limited by practical considerations of weight, transportability, and the like.

Geotextile tubes 12 may be designed to provide structural integrity for, and retention of, a wide variety of earthen materials, including fine-grained fill. A filled geotextile tube 12 may assume a cross-section that is rounded on the edges (i.e. front side 22, back side 24, ends 26) and generally flat on the top 18 and bottom 20. Experience has shown that geotextile tubes 12 may be filled up to seventy to eighty percent of their theoretical maximum capacity. However, a percentage less than fifty to sixty percent is more commonly and easily accomplished. For use within the present invention, a container 12 may be filled to any desired percentage, but would generally be filled to much less than the theoretical capacity for the present invention. Accordingly, a geotextile tube 12 typically would be filled to less than fifty percent of its theoretical maximum capacity.

A container 12 may be filled with earthen material in any suitable manner. In selected embodiments, apertures 34 may be regularly spaced along the length 28 of the container 12. The size of the apertures 34 and the distance 36 therebetween may be determined by the characteristics of the earthen material being inserted therein. For example, in embodiments where a container 12 comprises a geotextile tube 12, the distance 36 between the apertures 34 may be determined according to the settling characteristics of the earthen material. In such cases, the slower the settling time, the greater the distance 36 between apertures 34.

In certain embodiments, the apertures 34 may be sealable. For example, an aperture 34 may include an inlet or outlet tube 38 secured thereto. To seal the aperture 34, the tube 38 may be tied-off, folded, or otherwise closed after filling. In other embodiments, the apertures 34 may remain open. For example, an aperture 34 formed as a slot may be left unsealed in that the amount of earthen material able to exit therethrough may be limited.

Figure 2:
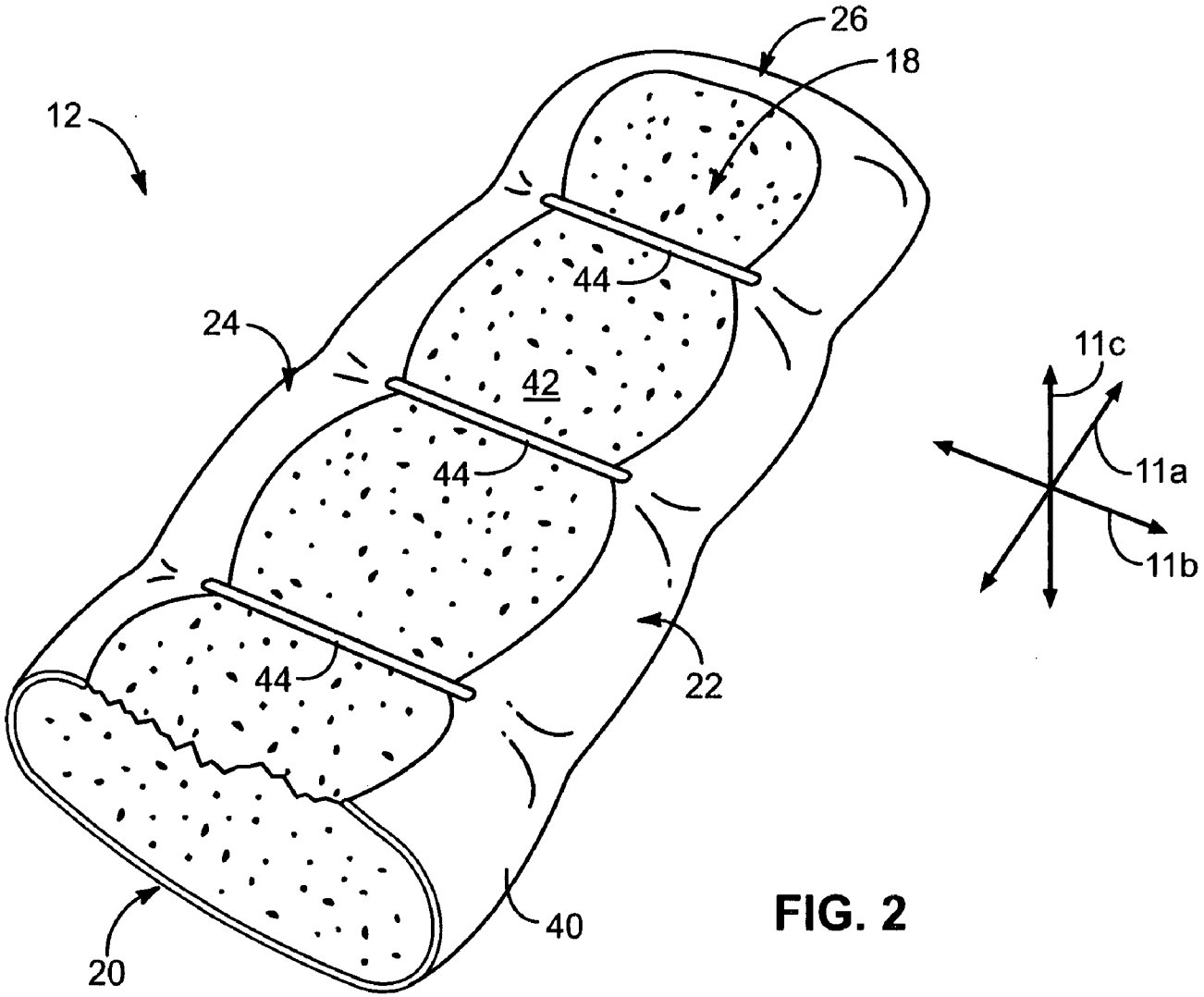
FIG. 2 is a perspective view of a partially enclosed container for use in a geosynthetic reinforcement in accordance with the present invention.

Referring to FIG. 2, containers 12 in accordance with the present invention may provide a full or a partial enclosure. Determinations of whether to use a fully enclosed container 12 or a partially enclosed container 12 may depend largely on the nature of the earthen material and the manner in which the earthen material is to be inserted within the container 12. For example, it may be preferable to use a fully enclosed container 12 when filling with dredged material. Alternatively, it may be preferable to use a partially enclosed container 12 when filling with a less fluid material.

In certain embodiments, a container 12 may be used with high-moisture, fine-grained fill that is too wet to compact with conventional earthworking equipment. Such fill, however, may not have enough moisture to be placed by pumping. In such embodiments, this high moisture earthen material 42 may be placed on the material 40 forming the container 12. The material 40 may then be wrapped or otherwise secured to contain the earthen material 42.

A partially enclosed container 12 may be formed in any suitable manner. For example, in one embodiment, the material 40 forming the container 12 may be laid flat over a selected area. Earthen material 42 may be deposited on top thereof. The front and back sides 22, 24 of the container 12 may be formed by pulling the container material 12 up and around the earthen material 42. The front and back sides 22, 24 may then be secured together in any suitable manner. In such an embodiment, the amount of earthen material 42 may determine whether the front side 22, back side 24, or ends 26 have any overlap (i.e. whether the container 12 has an enclosed top 18).

In an alternative embodiment, a partially enclosed container 12 may include one or more tethers 44 connecting the front side 22 to the back side 24. A tether 44 may be formed of a similar or dissimilar material with respect to the container material 40. Accordingly, the top 18 of the container 12 in such embodiments may be left open. This open top 18 may function as a large filling aperture 34 through which earthen material 42 may be inserted.

Figure 3:
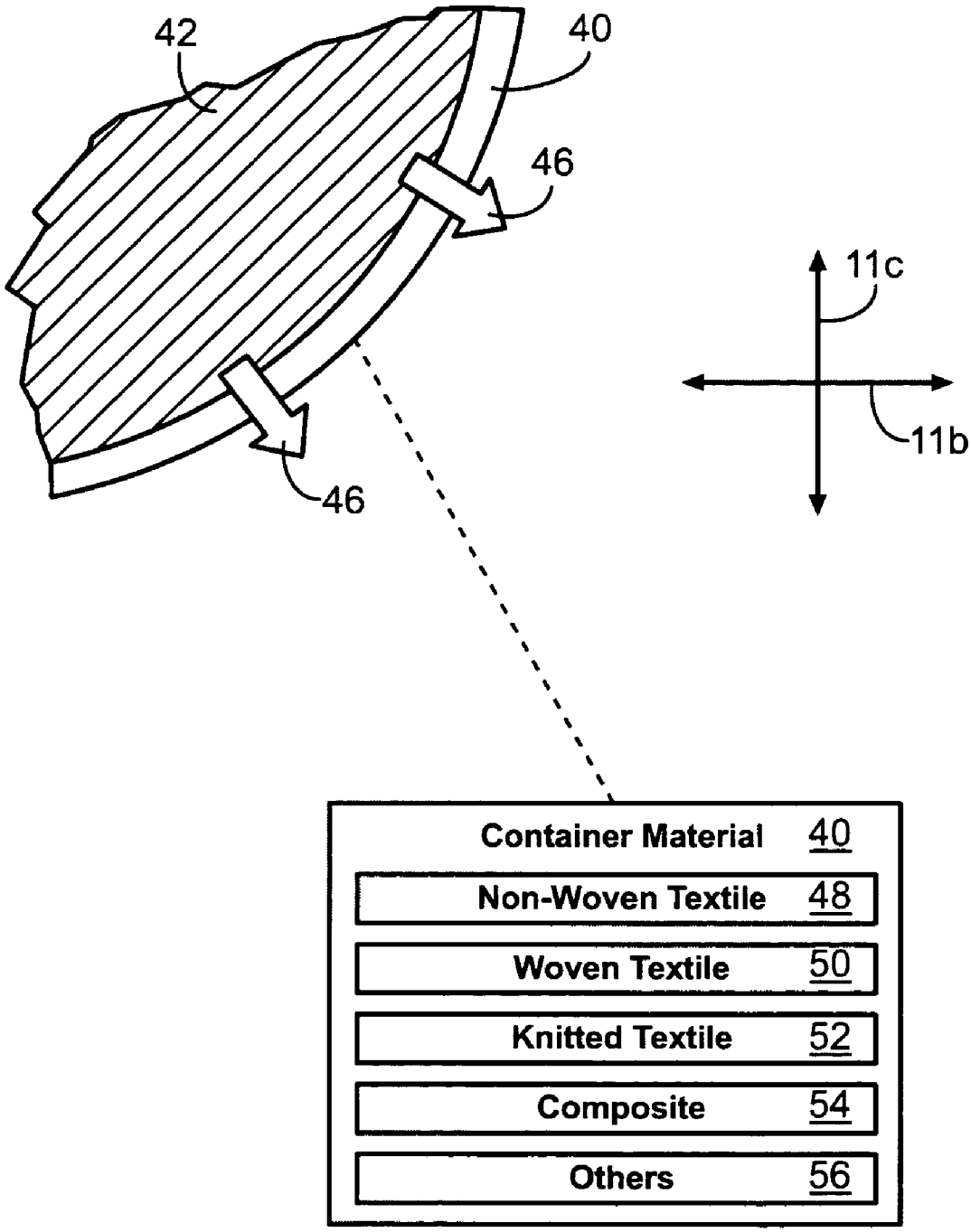
FIG. 3 is a schematic diagram comprising a partial, cross-sectional view of a filled container in accordance with the present invention and a corresponding chart listing various materials that may be used to create such a container.

Referring to FIG. 3, various factors may be considered when selecting the material 40 of a container 12. Such factors may include strength, puncture resistance, toughness, resistance to degradation, resistance to ultraviolet radiation, chemical stability, permeability, cost, availability, weight, and the like.

In selected embodiments, the container material 40 may be semipermeable. For example, the material 40 may be permeable to water 46 and substantially impermeable to the earthen material 42 held within the container 12. In certain embodiments, this semipermeability may be controlled by the size of the interstitial spaces between the fibers, strands, filaments, etc. that form the material 40.

Suitable container material 40 may comprise a non-woven textile 48. In general, there are three types of non-woven textile 48, namely heat-bonded, needle-punched, and spun-bonded. Non-woven textile 48 may be manufactured in a variety of thicknesses. Typically, the thicker the non-woven textile 48, the greater its strength. Non-woven textiles 48 are highly permeable. They also are able to stretch and take the shape of the fill material 42 or that of adjacent surfaces.

In some embodiments, container material 40 may comprise a woven textile 50. In general, woven textiles 50 are strong and do not stretch significantly when loaded. Typical woven textiles 50 are formed of polypropylene or polyester, however, other synthetics or naturally occurring materials may be used.

Woven textiles 50 are usually classified into one of three categories. The first category comprises a flat, tape-like strand produced by slitting and weaving a sheet of extruded film. The second category comprises monofilament fabrics formed of individually woven strands. The third category comprises multifilament fabrics formed of many fine, continuous filaments held together by twisting or otherwise interconnecting the strands.

In other embodiments, container material 40 may comprise a knitted textile 52. Knitted textiles 52 may be formed by interlooping one or more fibers, strands, filaments, etc. Similar to woven textiles, knitted textiles 52 may be formed of polypropylene, polyester, other synthetics, or naturally occurring materials.

In selected embodiments, container material 40 may comprise a composite 54. That is, the container material 40 may be formed by combining various types of textiles 48, 50, 52 or other materials. For example, container material 40 may comprise a filter layer formed of a non-woven textile 48 combined with a structural layer formed of a woven textile 50.

Container material 40 may comprise another material 56 or combination of materials 56 other than those listed hereinabove. In general, any material providing the desired permeability, strength, and resistance to degradation may be used.

Figure 4:
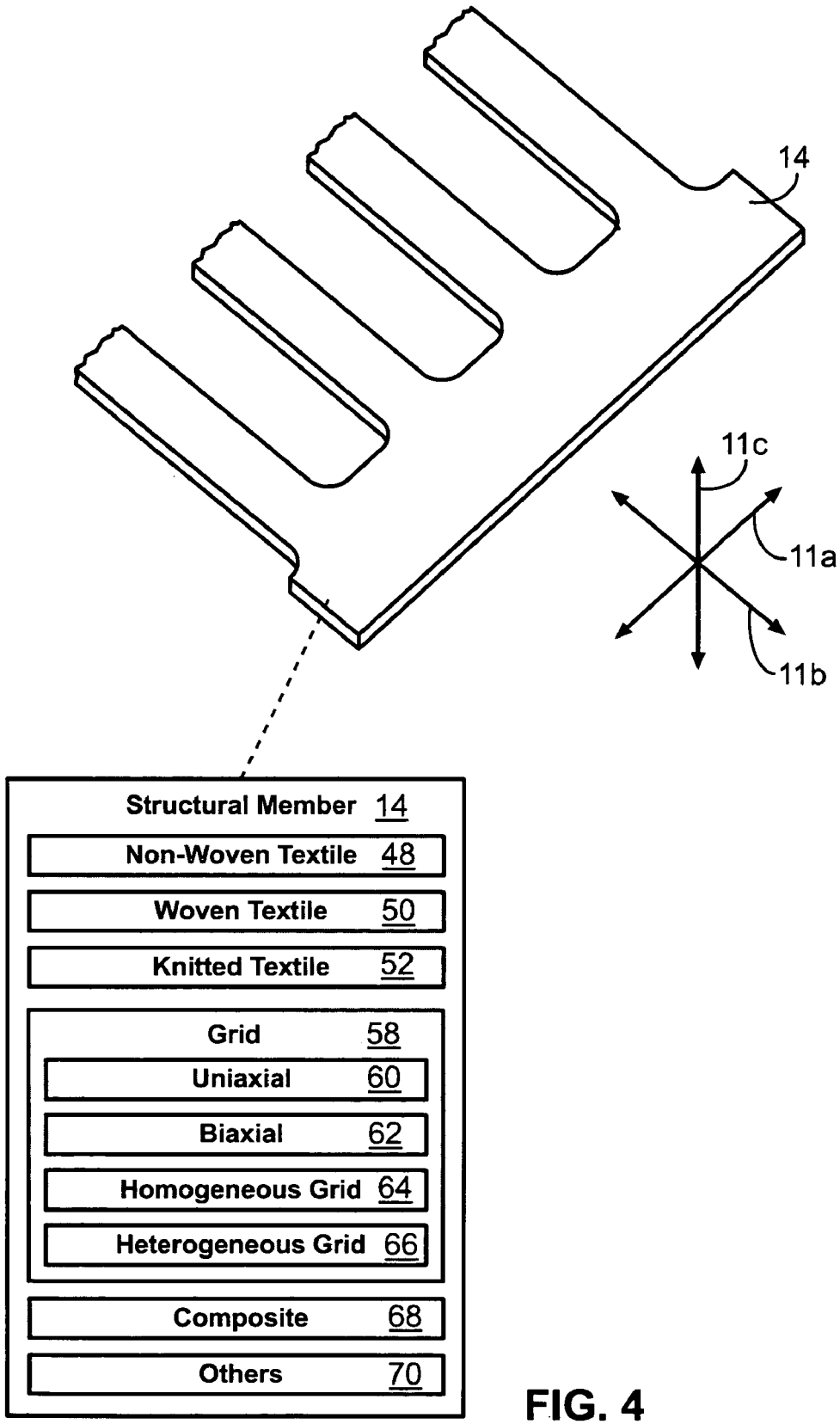
FIG. 4 is a schematic diagram comprising a partial, perspective view of a structural member in accordance with the present invention and a corresponding chart listing various materials that may be used to create such a member.

Referring to FIG. 4, the material or materials used in forming a structural member 14 in accordance with the present invention may be selected to provide a desired strength, toughness, engagement, resistance to degradation, resistance to ultraviolet radiation, chemical stability, and the like. Other factors that may be considered in selecting the material for the structural member 14 may include cost, availability, weight, and the like.

In selected embodiments, a structural member 14 may comprise a fabric. For example, non-woven textiles 48, woven textiles 50, knitted textiles 52, and the like may be suitable. In embodiments imposing greater loads, a structural member 14 may comprise a grid 58. In general, a grid 58 may comprise a manufactured sheet of connected elements forming a regular network. Typically, the openings between the connected elements are greater in size than the connected elements themselves.

A grid 58 for use as a structural member 14 may be uniaxial 60 or biaxial 62. For example, in applications where the load is applied to the structural member 14 in the lateral direction 11*b*, then a uniaxial grid 60 aligned with the lateral direction 11*b* may suffice. In other embodiments where loads may be applied in more than one direction, a biaxial grid 62 may be used.

A grid 58 for use as a structural member 14 may be homogeneous 64 or heterogeneous 66. That is, a grid 58 may be formed of a single material or combinations of dissimilar materials. For example, in selected embodiments, a homogeneous grid 64 formed by uniaxially or biaxially stretching an extruded polymeric material may be suitable. In other embodiments, a heterogeneous grid 66 formed by impregnating an interlaced mesh with a binder may be used. In still other embodiments, a heterogeneous grid 66 may be formed by coating a metal grid or mesh with a protective, oxidation-reducing layer.

In selected embodiments, a structural member 14 may comprise a composite 68. That is, the structural member 14 may be formed by combining various types of textiles 48, 50, 52, grids 58, and the like. Additionally, a structural member 14 may comprise another material 70 or combination of materials 70 other than those listed hereinabove. In general, any material providing the desired strength and resistance to degradation may be used.

Figure 5:
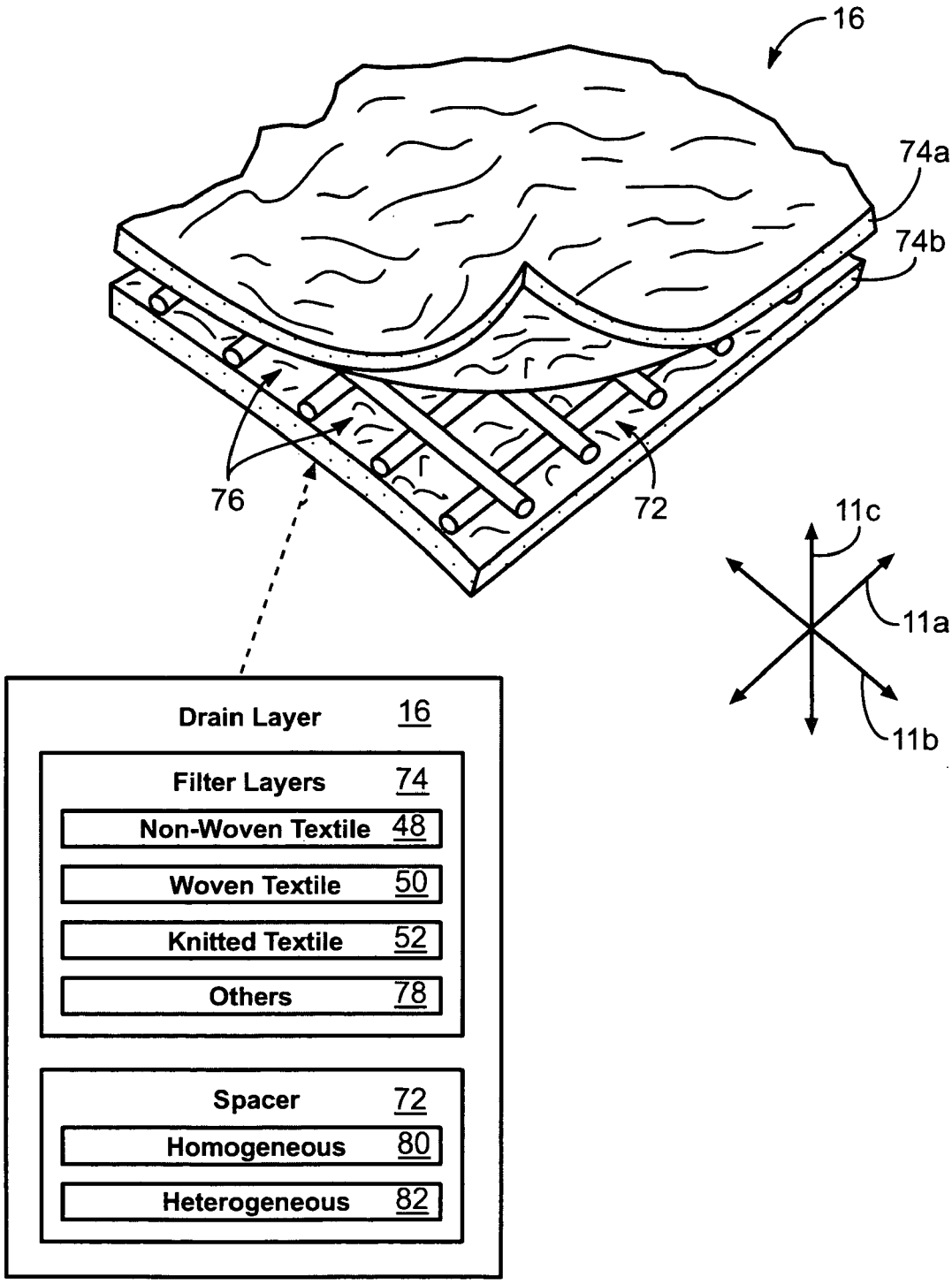
FIG. 5 is a schematic diagram comprising a partial, perspective view of a drain layer in accordance with the present invention and a corresponding chart listing various materials that may be used to create such a layer.

Referring to FIG. 5, a drain layer 16 may comprise any material or combination of materials providing a preferential path for water and other liquids to travel. In general, a drain layer 16 may be formed by positioning a spacer 72 between two filter layers 74*a*, 74*b*. The spacer 72 may provide an interconnected network of voids 76. The filter layers 74*a*, 74*b* may stop soils and the like from entering, filling, and blocking the voids 76 of the spacer 72. Accordingly, the voids 76 are only accessible to the liquids capable of passing through the filter layers 74*a*, 74*b*.

In selected embodiments, filter layers 74 may be formed of a fabric. For example, non-woven textiles 48, woven textiles 50, knitted textiles 52, and the like may be suitable. Other materials 78 may also be used, so long as they provide the desired filtering capability.

A spacer 72 may be formed of a single, homogeneous material 80 or any heterogeneous combination of suitable materials 82. For example, in selected embodiments, a homogeneous grid 64 may function suitably as a spacer 72. Alternatively, specifically designed geonets may provide a more uninhibited network of voids 76. Other suitable spacers 72 may include textiles 48, 50, 52, gravel, sand, etc.

Figure 6:
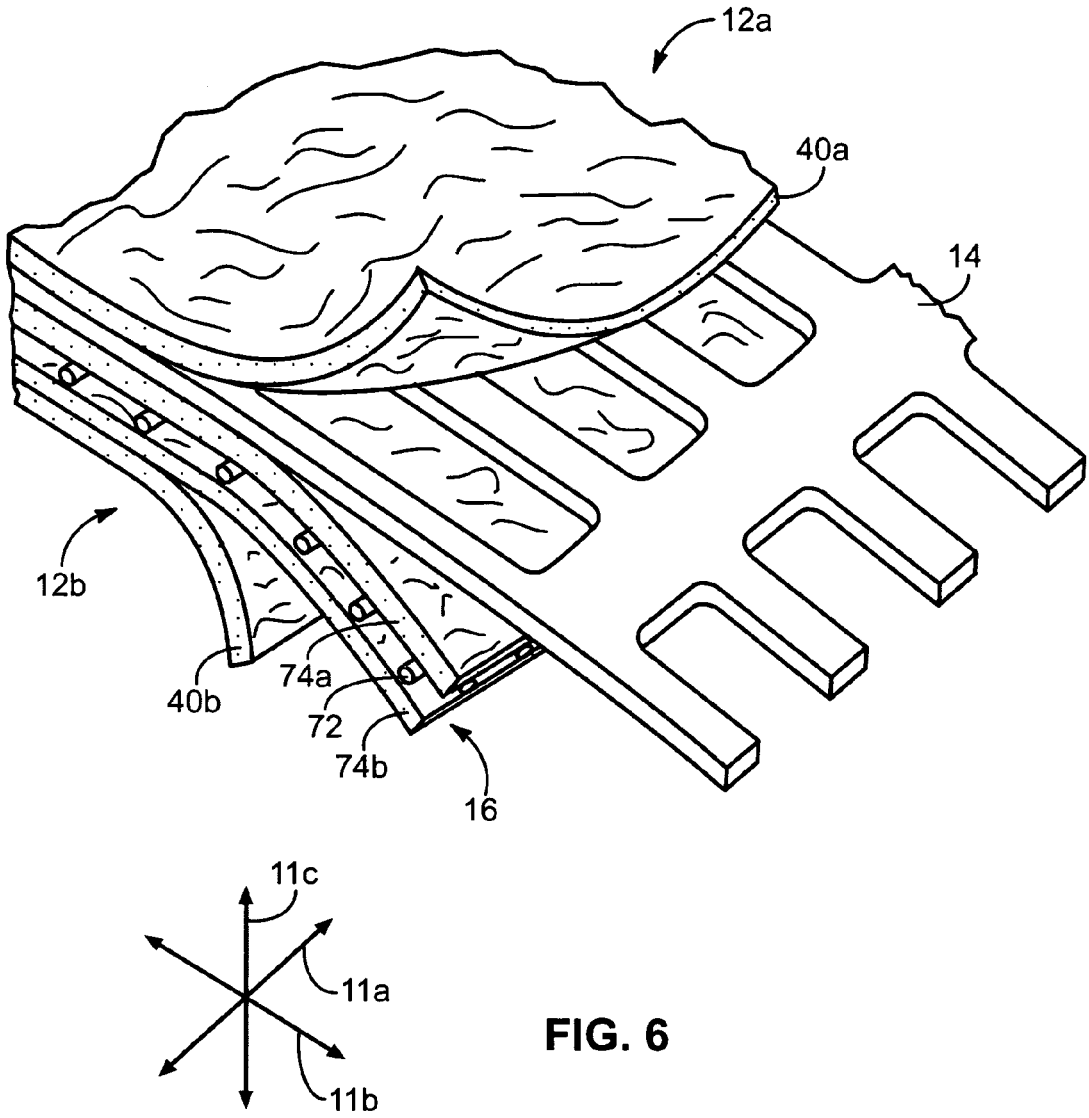
FIG. 6 is a partial, perspective view of a structural member and drain layer positioned between upper and lower containers in accordance with the present invention.

Referring to FIG. 6, a geosynthetic reinforcement 10 in accordance with the present invention may comprise one or more containers 12 stacked to support one another. For example, a first container 12*a*, formed of a first container material 40*a*, may be positioned at least partially above a second container 12*b*, formed of a second container material 40*b*. A structural member 14 and drain layer 16 may be positioned between the containers 12*a*, 12*b*. In certain embodiments, the structural member 14 may be positioned above the drain layer 16. In other embodiments, the structural member 14 may be positioned below the drain layer 16.

In selected embodiments, the structural member 14 may directly engage one container 12*a*, 12*b* and indirectly engage the other 12*b*, 12*a*. For example, the structural member 14 may engage the first container 12*a* directly (e.g. by bonding, fastener, friction, etc.). The same structural member 14 may also engage the drain layer 16, which in turn may engage (e.g. frictionally) the second container 12*b*. Accordingly, the structural member 14 may indirectly engage the second container 12*b*. In such an arrangement, loads applied to the structural member 14 may be transferred to both the first and second containers 12*a*, 12*b*.

If desired, a structural member 14 may be modified or adapted to increase the engagement strength with the one or more containers 12. For example, in embodiments relying on a frictional engagement, the surface of the structural member 14 may be roughened, textured, etc. to increase the coefficient of friction or micro-mechanical gripping at the interface between the two elements 12*a*, 14.

Figure 7:
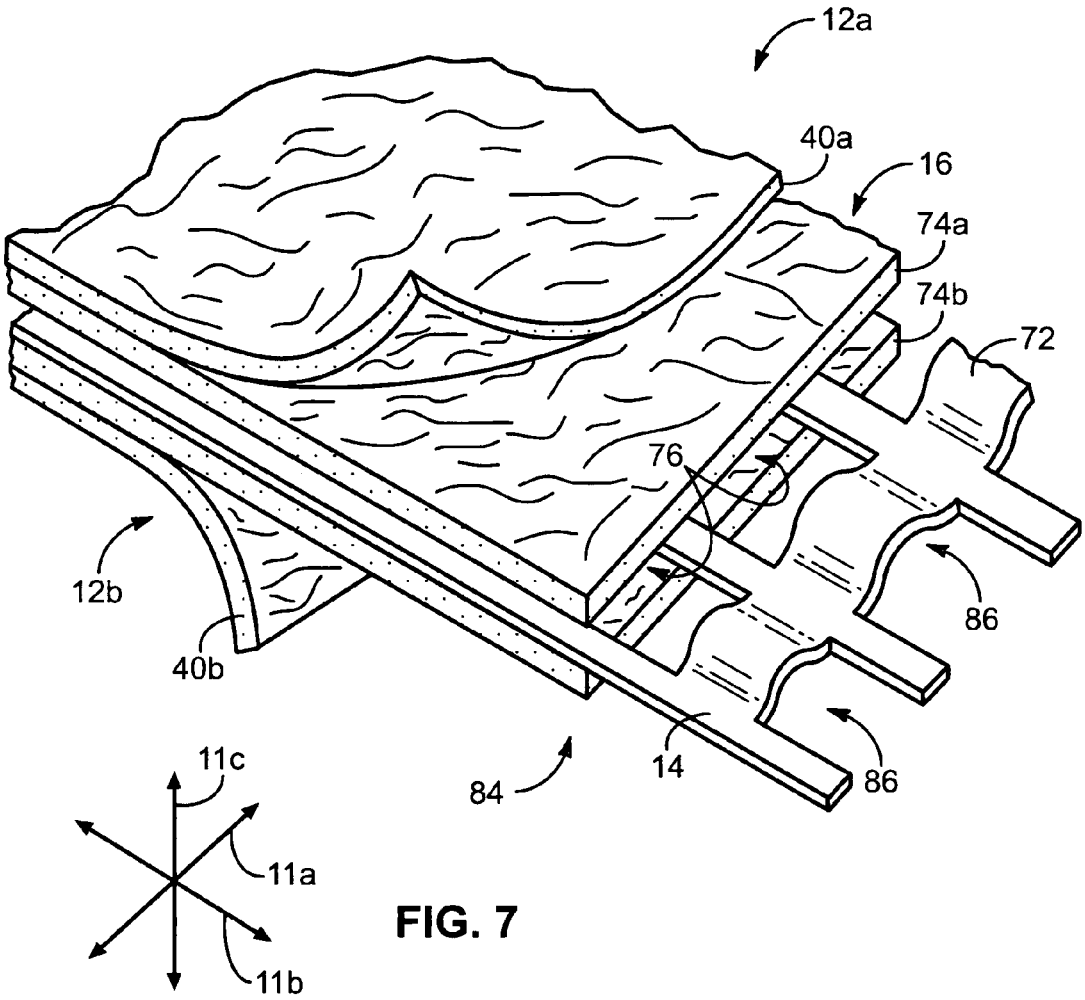
FIG. 7 is a partial, perspective view of a structural member positioned between upper and lower filter layers to form a multifunction layer in accordance with the present invention.

Referring to FIG. 7, in certain embodiments, the structural member 14 and the drain layer 16 may be combined into a multifunction layer 84. For example, in addition to performing its normal function, a structural member 14 may also function as the spacer 72 within a drain layer 16. Accordingly, the amount of space (thickness in the transverse direction 11*c*) and materials required may be reduced.

In such embodiments, the structural member 14 may be modified or adapted to provide an interconnected network of voids 76. For example, in one embodiment, various connecting members 86 incorporated with the structural member 14 may be bowed or otherwise formed to space the filter layers 74*a*, 74*b* and create the voids 76 necessary for adequate flow.

A multifunction layer 84 may be manufactured on or off-site. For example, in selected embodiments, a multifunction layer 84 may be formed by laminating and connecting the filter layers 74*a*, 74*b* and structural member 14 in a factory process.

Alternatively, a multifunction layer 84 may be fabricated on-site by positioning (e.g. rolling out) a lower filter layer 74*b*, positioning a structural member 14 on top of the lower filter layer 74*b*, and positioning an upper filter layer 74*a* on top of the structural member 14. In such embodiments, loads applied to the structural member 14 may be transferred to the filter layers 74*a*, 74*b*, and from the filter layers 74*a*, 74*b* to any neighboring containers 12. If desired, the structural member 14 may be roughened, textured, etc. to provide an improved engagement with the filter layers 74*a*, 74*b*. Similarly, the filter layers 74*a*, 74*b* may be textured or otherwise modified to provide an improved engagement with the container material 40.

In selected applications, it may be desirable to provide a container 12 incorporating a multifunction layer 84. For example, in a manufacturing process, a multifunction layer 84 may be bonded, welded, fastened, or other wise connected to the top 18, bottom 20, etc. of a container 12. Positioning such a container 12 may simultaneous install the structural member 14 and drain layer 16, thereby reducing the time and effort of on-site installation.

In such embodiments, the container material 40 may function as a filter layer 74. Accordingly, any potentially redundant filter layer 74 may be eliminated. For example, in some embodiments, the upper filter layer 74*a* may be omitted and the structural member 14 may be secured directly to the bottom 20 of the container 12. Similarly, in other embodiments, the lower filter layer 74*b* may be omitted and the structural member 14 may be secured directly to the top 18 of the container 12.

Figure 8:
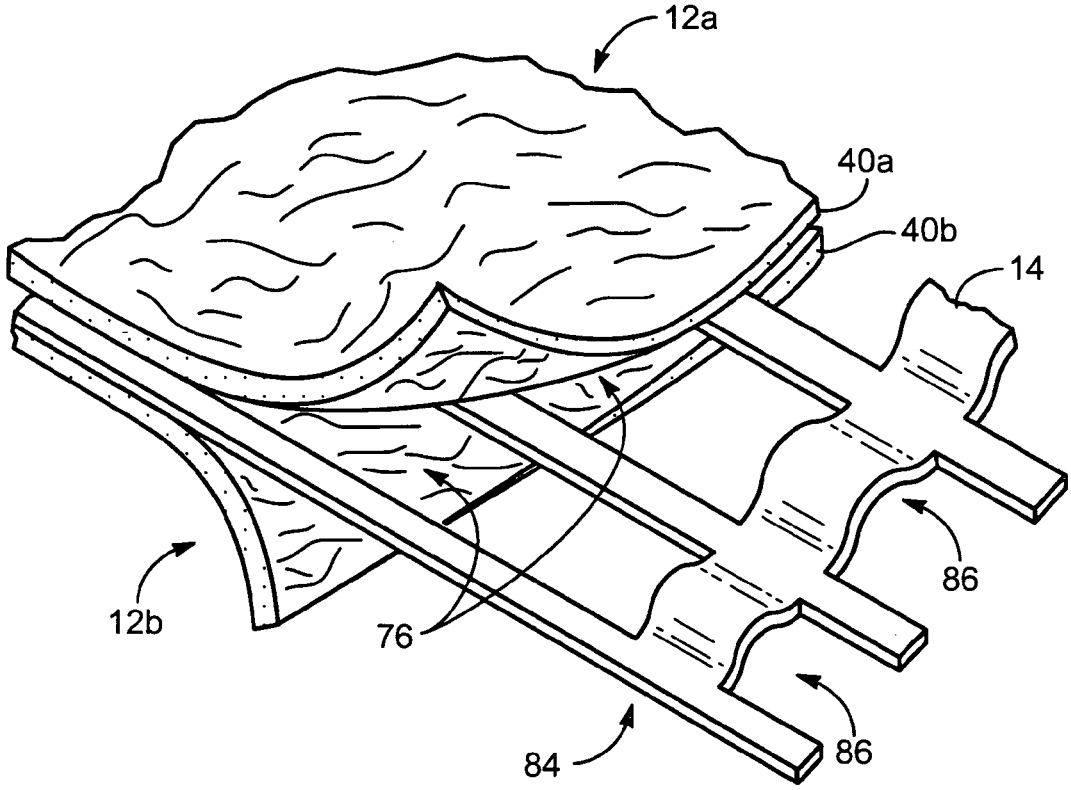
FIG. 8 is a partial, perspective view of a structural member positioned between upper and lower containers and forming an alternative embodiment of a multifunction layer in accordance with the present invention.
Figure 8:
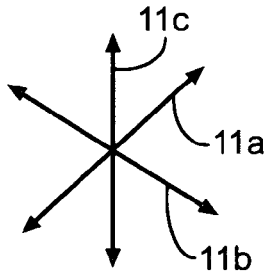

Referring to FIG. 8, in selected embodiments, a multifunction layer 84 may include only a structural layer 14. In such embodiments, the container material 40*a* of an upper container 12*a* may function as an upper filter layer 74*a*. Similarly, the container material 40*b* of a lower container 12*b* may function as a lower filter layer 74*b*. Finally, the structural member 14 may function as a spacer 72 between the various layers of container material 40*a*, 40*b*. As noted hereinabove, the structural member 14 may be modified or adapted to provide an interconnected network of voids 76.

In certain embodiments, a structural member 14 acting as a multifunction layer 84 may frictionally engage a container 12*a* positioned thereabove, a container 12*b* positioned therebelow, or both. Again, the surface of the structural member 14 may be roughed, textured, etc. to increase the coefficient of friction or micro-mechanical gripping at the interface between the various elements 12*a*, 12*b*, 14.

Alternatively, the structural layer 14 may be bonded, welded, fastened, or otherwise connect to one of the containers 12*a*, 12*b*. For example, in one embodiment, a multifunction layer 84 may be welded to the bottom 20 of a container 12 in a factory manufacturing process. In another embodiment, during on-site installation, the structural member 14 may be looped completely or partially around one or more of the containers 12*a*, 12*b*.

Figure 9:
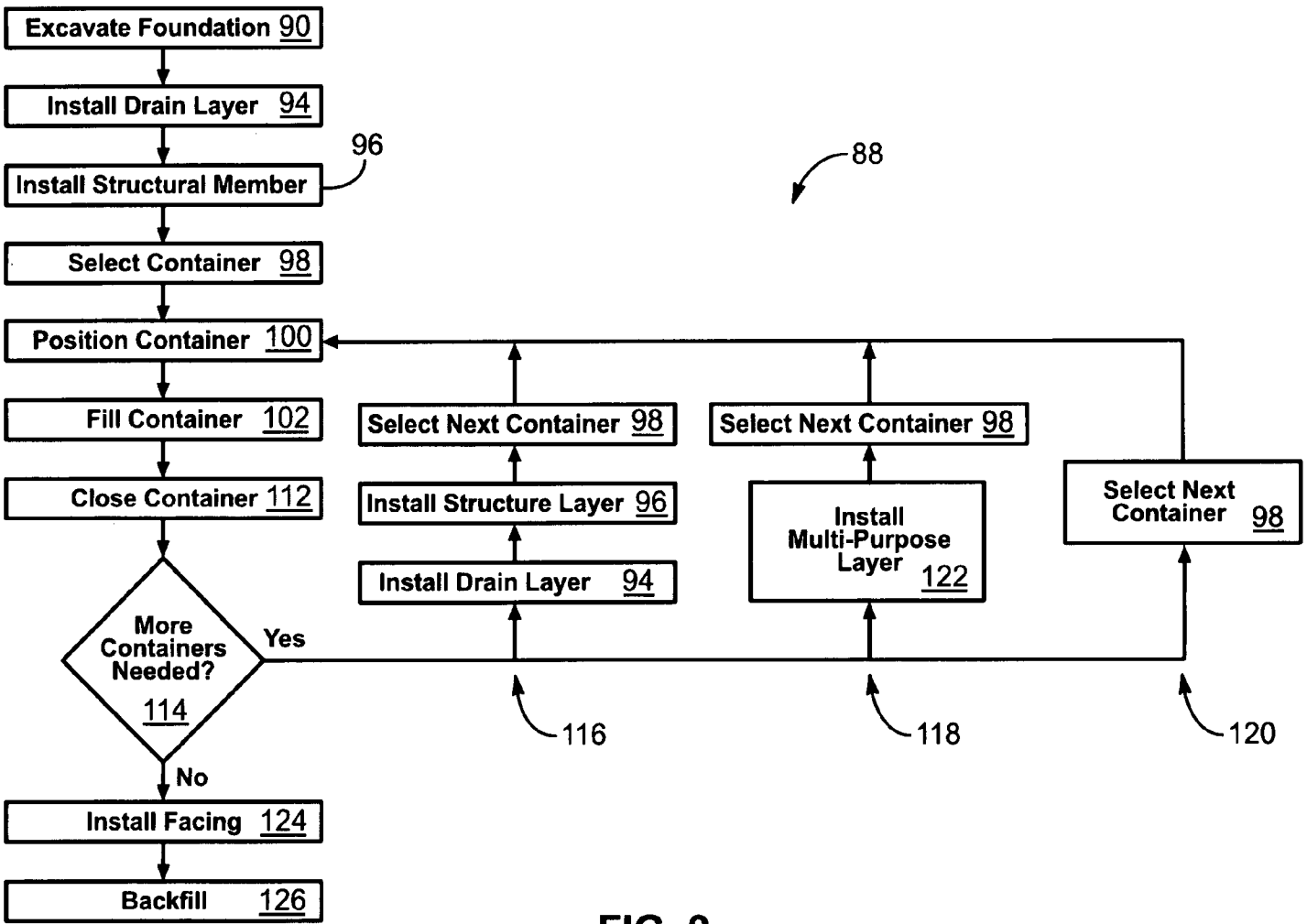
FIG. 9 is a schematic, block diagram of a method for installing a geosynthetic reinforcement in accordance with the present invention.
Figure 10:
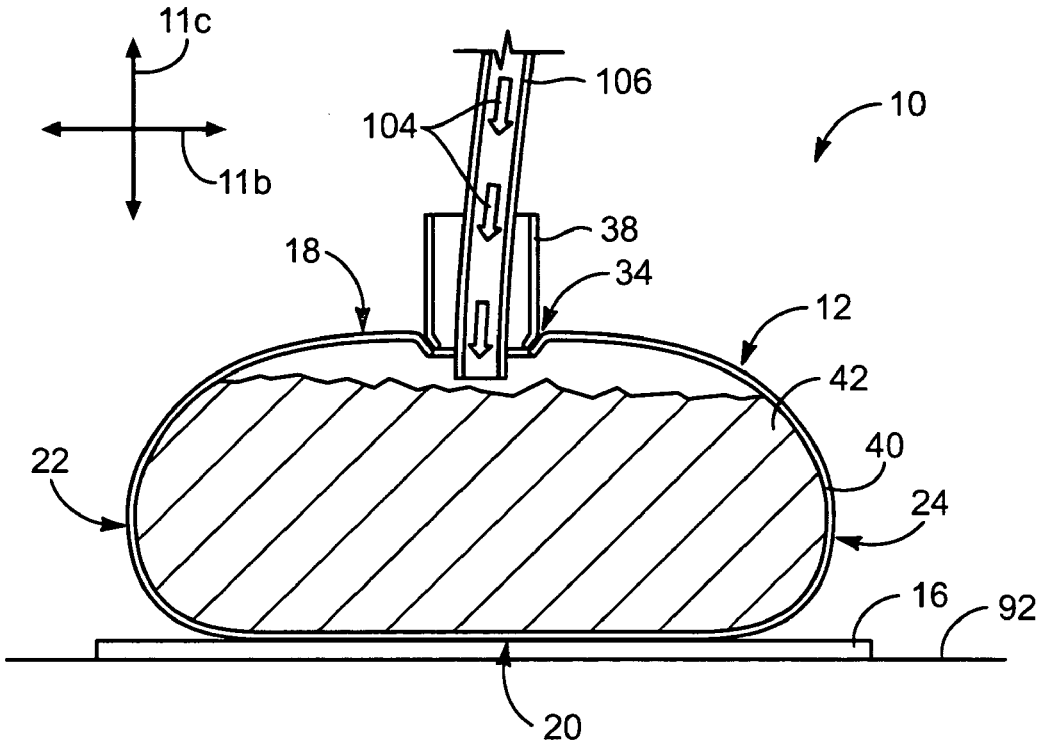
FIG. 10 is a cross-sectional view of a container being filled with an earthen material in accordance with the present invention.
Figure 11:
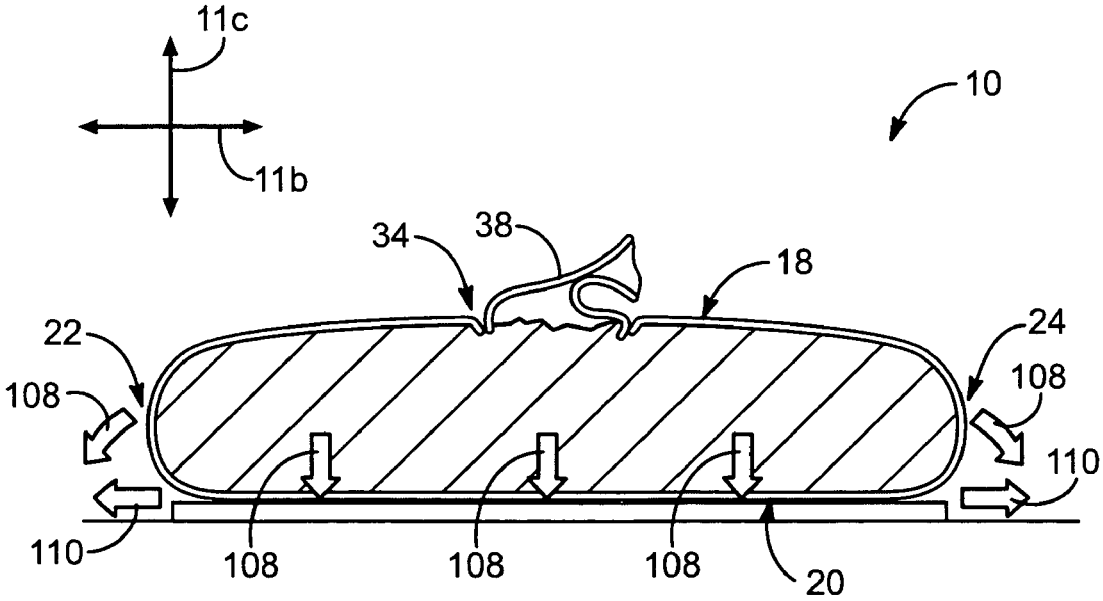
FIG. 11 is a cross-sectional view of a container undergoing consolidation in accordance with the present invention.
Figure 12:
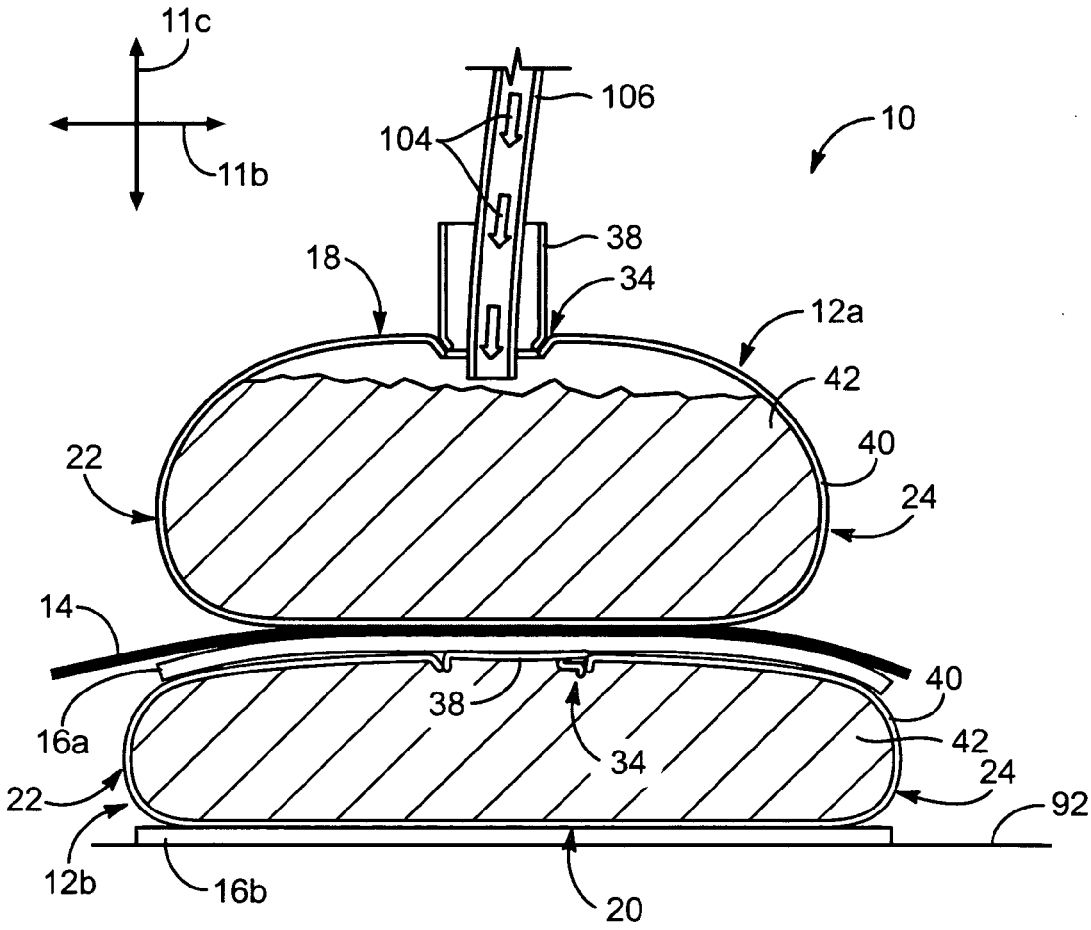
FIG. 12 is a cross-sectional view of an upper container positioned on-top-of a lower container with a drain layer and structural member therebetween, the upper container is in the process of being filled and is aiding in the compaction of the lower container in accordance with the present invention.

Referring to FIGS. 9–11, installation 88 of a geosynthetic reinforcement 10 in accordance with the present invention may begin with excavation 90 of a foundation 92. The amount and type of excavation 90 may depend largely on the nature of the terrain and the nature of the reinforcement 10. For example, excavation 90 for a retaining wall may differ significantly from excavation 90 for a causeway.

In selected embodiments, once excavation 90 is completed, a drain layer 16 may be installed 94. Installation 94 of a drain layer 16 may include installation 94 of appropriate drain conduits, wicks, or the like. For example, any suitable arrangement of drain conduits may be installed to collect and properly dispose of water expressed from a drain layer 16.

If desired, one or more structural members 14 may be installed 96. These structural members 14 may be installed below the drain layer 16, above the drain layer 16, as part of the drain layer 16, or some combination thereof. Alternatively, the one or more structural members 14 may be omitted. For example, in the illustrated embodiment, a structural member 14 is not included due to the close proximity and stabilizing effect of the foundation 92.

Installation 88 may continue with the selection 98 of a container 12. Factors that may be considered when selecting 98 a container 12 may include the size of the geosynthetic reinforcement 10, the type of earthen material 42 that will be placed within the container 12, the cost of the container 12, the ease of manufacture, the ease of filling with earthen material 42, the required permeability for the container 12, etc. Once selected 98, the container 12 may be positioned 100 and filled 102.

The manner in which a container 12 is filled 102 may depend largely on the nature of the fill 42. For example, in selected embodiments, it may be desirable to fill 102 a container 12 with silt, fine river sand, locally available fines, or the like. In such embodiments, the container 12 of choice may comprise a geotextile tube. Such a container 12 may be filled 102 using a highly fluidized mixture 104 of water and fill 42. This mixture 104 may be collected by a dredge or pump and delivered to the container 12 through various conduits 106. If desired or necessary, fortifying materials (e.g. cement, bentonite, sand, etc.) may be added to the mixture 104 before it is introduced into the container 12. For example, an in-line, high shear mixer may be incorporated to facilitate the addition of solid materials.

In other embodiments, fill 42 may be delivered to a container 12 in a less fluidized state. In such embodiments, the manner of filling 102 may be adapted to compensate for the decreased, natural distribution of fill 42 within the container 12. For example, the number, proximity, size, etc. of the apertures 34 for receiving fill 42 may be increased. Alternatively, partially enclosed containers 12, as discussed hereinabove, may be employed. In still other embodiments, water may be added to fluidize the fill 42 before it is introduced into the container 12. In other embodiments, high moisture fill 42 may be placed on the material 40 forming the container 12. The material 40 may then be wrapped or enclosed to form the container 12.

In embodiments employing containers 12 formed of semi-permeable material 40, excess water within the fill 42 may exit 108, while the fill 42 itself remains. Accordingly, the fill 42 may tend to collect and consolidate within the container 12. Water exiting 108 containers 12 through the bottom 20 may enter the drain layer 16 and be efficiently carried away 110. In this manner, the path that water must travel within the fill 42 to exit 108 the container 12 may be effectively shortened. Accordingly, the drain layer 16 may effectively increase the rate at which fill 42 consolidates within the container 12. In embodiments employing flexible containers 12 that mutually conform with the fill 42, consolidation generally causes the container 12 to flatten on the top 18 and bottom 20 and round on the front and back sides 22, 24.

In selected embodiments, water may begin exiting 108 a container 12 before the container 12 is filled 102 to capacity. For example, in some embodiments, a highly fluidized mixture 104 may be pumped into a container 12. In such embodiments, large amounts of water must exit 108 the container 12 so that fill 42 may collect therewithin.

Accordingly, in some cases, a highly fluidized mixture 104 may be pumped into one aperture 34, while another aperture 34 is left open. In such cases, the fill 42 contained within the mixture 104 may settle out of a comparatively slowly moving flow of liquid before it has the chance to exit through the open aperture 34. As a result, large amounts of substantially clear water (i.e. water containing very little fill 42) may exit through the open aperture 34 and fill 42 may collect within the container 12. When the container 12 is filled 102 to a desired level, the apertures 34 may be closed 112 to resist the escape of the entrapped fill 42.

Installation 88 of a geosynthetic reinforcement 10 in accordance with the present invention may continue with a determination 114 of whether an additional container 12 is needed. If an additional container 12 is needed, various options 116, 118, 120 are available. In the first option 116, another drain layer 16 may be installed 94, a structural member 14 may be installed 96, and another container 12 may be selected 98. In the second option 118, a multifunction layer 84 may be installed 122 and another container 12 may be selected 98. In the third option 120, another container 12 may be selected 98. Following each of these options 116, 118, 120, the newly selected container 12 may be positioned 100 with respect to the previous container 12, and the installation 88 may continue.

One container 12 may be positioned 100 with respect to another container 12 in any suitable manner. For example, in selected embodiments, containers 12 may be stacked to support one another, thereby providing a geosynthetic reinforcement 10 having significant height. Alternatively, a geosynthetic reinforcement 10 may be rather long. Accordingly, one container 12 may be positioned 100 end-to-end with the previous container 12. In other embodiments, a geosynthetic reinforcement 10 may require a significant width. In such embodiments, one container 12 may be positioned 100 side-by-side with the previous container 12. In still other embodiments, containers 12 may be stacked, positioned 100 end-to-end, positioned 100 side-by-side, crossed, or some combination thereof. If desired, containers 12 may be staggered with respect to one another to avoid potentially undesirable propagation of structural vulnerabilities.

In selected embodiments, stacking of containers 12 may be used to speed consolidation. For example, by positioning one container 12*a* on-top-of another 12*b*, the weight of the upper container 12*a* may effectively squeeze water from the lower container 12*b*. Moreover, in certain embodiments, a drain layer 12*a* positioned between the upper and lower containers 12*a*, 12*b* may limit the amount of water passing therebetween. That is, water from the upper container 12*a* may be removed through the drain layer 12*a* before it can permeate the lower container 12*b* in significant quantities.

Installation 88 may continue until it is determined 114 that no additional container 12 is needed. At that point, facing (e.g. cement, cement block, rock, sod, etc.) may be installed 124 as necessary or desired to protect the reinforcement 10. In selected embodiments, installation 124 of the facing may include connecting the facing to one or more of the structural members 14. For example, in embodiments were the facing comprises a retaining wall, the structural members 14 may be connected thereto. The geosynthetic reinforcement 10 may be backfilled 126 before, concurrently with, or after the installation 124 of the facing. For example, in embodiments were the facing comprises sod, it may be advisable to first backfill 126.

Figure 13:
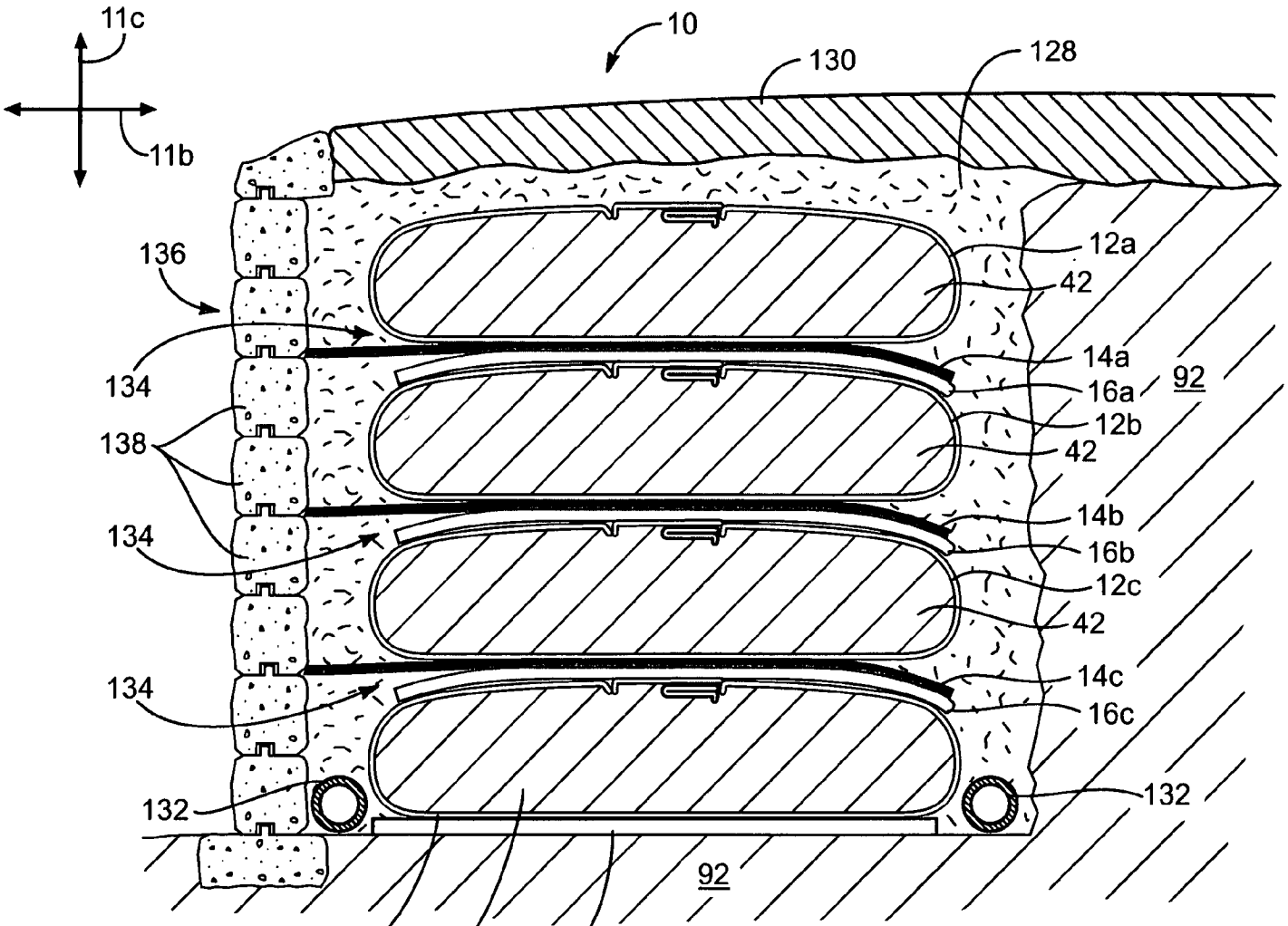
FIG. 13 is a cross-sectional view of a geosynthetic reinforcement in accordance with the present invention applied to a retaining wall.

Referring to FIG. 13, in selected embodiments, a geosynthetic reinforcement 10 may be arranged to facilitate dewatering during construction as well as during the life of the reinforcement 10. For example, backfill 128 facilitating drainage (e.g. granular fill) may be placed around an arrangement of containers 12. Accordingly, water entering the geosynthetic reinforcement 10 through the top soil 130, foundation 92, etc. may quickly be escorted down and away before it is able to permeate and weaken the earthen material 42 with the containers 12*a*, 12*b*, 12*c*, 12*d*. Conduits 132 may be incorporated as desired or necessary to assist in this evacuation of water.

The drain layers 16*a*, 16*b*, 16*c*, 16*d* located with the reinforcement 10 may efficiently drain water that has found its way into the containers 12*a*, 12*b*, 12*c*, 12*d*. Thus, the moisture content within geosynthetic reinforcement 10 may be maintained within ranges where the earthen material 42 exhibits sufficient strength (e.g. compressive strength).

Structural members 14*a*, 14*b*, 14*c* may be distributed as desired or necessary throughout a geosynthetic reinforcement 10. In selected embodiments comprising stacked containers 12, a structural member 14 may be positioned at each interface 134 between adjacent containers 12. For example, in one embodiment, a structural member 14 may extend from each interface 134 to engage a retaining wall 136. Alternatively, structural members 14 may extend only from every other (e.g. a Hernating) interface 134. In still other embodiments, the density of structural members 14 may be greater near the bottom of a reinforcement 10, where the loads imposed on the reinforcement 10 may be the greatest.

Structural members 14 may engage a supported structure (e.g. retaining wall 136) in any suitable manner. For example, in selected embodiments, a structural member 14 may be retained in the seam between the adjacent blocks 138 forming a retaining wall 136. Alternatively, a structural member 14 may be incorporated within the matrix of the supported structure as it is being constructed (e.g incorporated as concrete is being pored).

In view of the foregoing, it is clear that a multitude of schemes for positioning and engaging structural members 14 may be employed. All schemes that adequately accommodate the loads imposed or expected may be incorporated into geosynthetic reinforcements 10 in accordance with the present invention.

Figure 14:
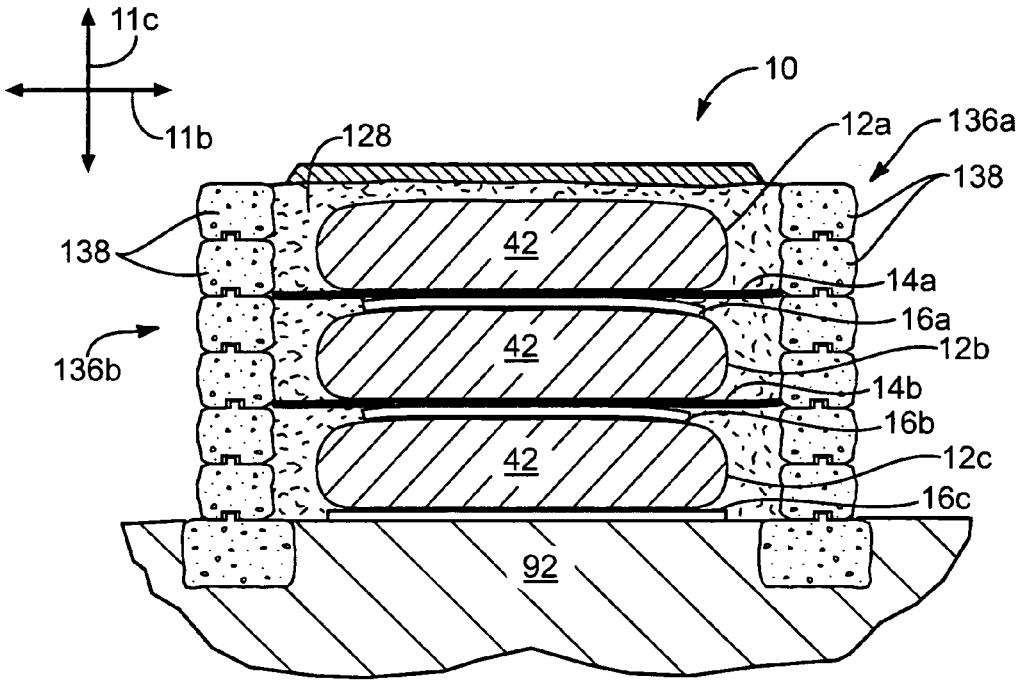
FIG. 14 is a cross-sectional view of a geosynthetic reinforcement in accordance with the present invention applied to a raised road way.

Referring to FIG. 14, in selected embodiments, a structural member 14 may extend to engage more than one structure. For example, in one embodiment, a structural member 14 may extend in one direction to engage one retaining wall 136*a*, while simultaneously extending in an opposite direction to engage another retaining wall 136*b*. Such arrangements may facilitate application of the present invention to double-sided reinforcements 10 (e.g. roads, causeways, etc.).

Figure 15:
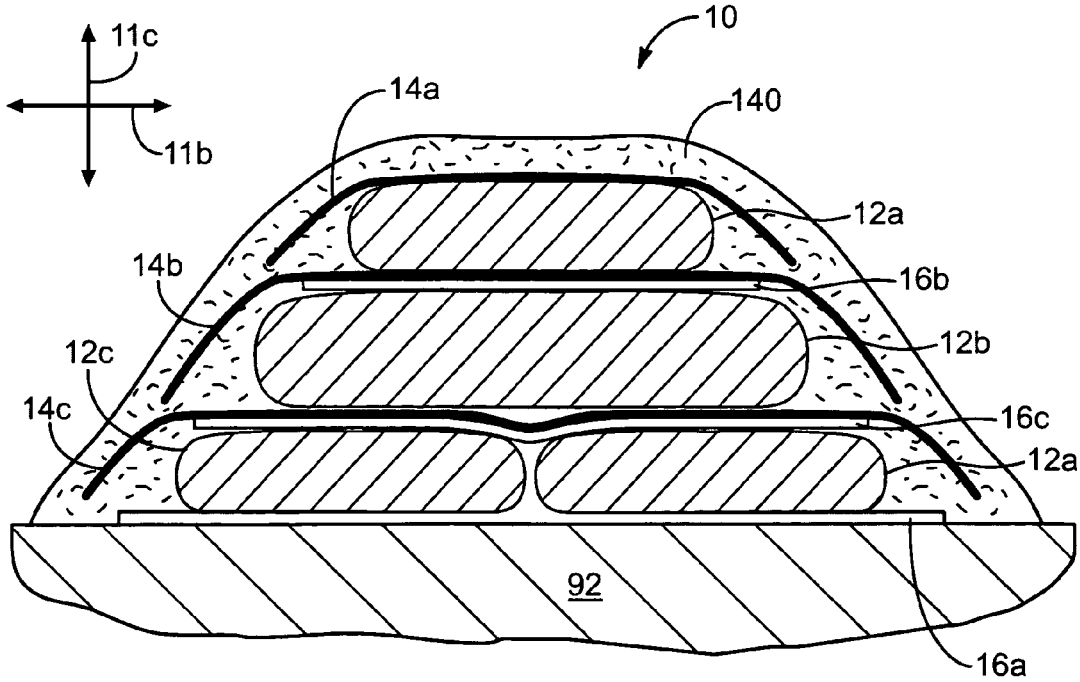
FIG. 15 is a cross-sectional view of a geosynthetic reinforcement in accordance with the present invention applied to an earthen dike.

Referring to FIG. 15, in selected embodiments, a structural member 14 may extend to engage a supported structure comprising an earthen material 140. For example, a structural member 14 may extend to engage an earthen material 140 and hold it on a slope 142 that is steeper than otherwise possible. Such arrangements may facilitate application of the present invention to sloped earthen reinforcements 10 such as berms, dikes, etc.

In certain embodiments where structural members 14 are not needed, they may be omitted. For example, in selected applications, multiple containers 12 may be stacked to form a berm whose slope is sufficiently shallow that reinforcement is not needed. In such applications, the structural members 14 may be omitted and the containers 12 may simply contain, consolidate, and dewater an otherwise unusable fill 42. Drain layers 16 may be incorporated as needed to control the water content within the containers 12.

If desired, a geosynthetic reinforcement 10 in accordance with the present invention may incorporate containers 12 of difference sizes. For example, to create a dike of generally triangular cross-section, multiple smaller containers 12*c*, 12*d* may be positioned side-by-side to form a base layer. On top of these containers 12*c*, 12*d* may be placed a single larger container 12*b*. Finally, on top of the larger container 12*b* may be placed a single smaller container 12*a*. In such a manner, a custom cross-section may be created, while maximizing the amount of fine-grained fill 42 that may be used within the reinforcement 10.

The present invention may be embodied in other specific forms without departing from its basic structures or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A reinforcement comprising:

an exterior layer;

an interior mass comprising:

a first container formed of a first semipermeable material and conformally containing a first quantity of an earthen material a second container formed of a second semipermeable material and conformally containing a second quantity of the earthen material;

the second container stacked to be supported by the first container; and a first structural member positioned between the first and second containers and extending to anchor the exterior layer to the interior mass.

2. The reinforcement of claim 1, wherein the first container is substantially tubular and the earthen material comprises particles sized to pass through a number two hundred sieve and at a concentration of at least thirty percent by weight.

3. The reinforcement of claim 2, wherein the first and second semipermeable materials are geosynthetics permeable to water and substantially impermeable to the earthen material.

4. The reinforcement of claim 3, further comprising a first drain layer positioned between the first and second containers, the drain layer formed of a material creating a network of interconnected voids conducting the flow of water through the drain layer.

5. The reinforcement of claim 4, further comprising a second drain layer positioned below the first container and provided with a network of interconnected voids permitting the flow of water therethrough.

6. The reinforcement of claim 5, further comprising:

the interior mass further comprising a third container formed of a third semipermeable material, conformally containing a third quantity of the earthen material, and stacked to be supported by the second container; and a second structural layer positioned between the second and third containers, the second structural layer transferring tensile loads applied thereto to the second and third containers.

7. The reinforcement of claim 1, further comprising:

a first drain layer positioned between the first and second containers;

the interior mass further comprising a third container formed of a third semipermeable material, conformally containing a third quantity of the earthen material, and stacked to be supported by the second container; and a second structural layer positioned between the second and third containers, the second structural layer transferring tensile loads applied thereto to the second and third containers; and a second drain layer positioned between the second and third containers.

8. A retaining wall reinforcement comprising:

earthen material;

a first container, formed of semipermeable material mutually conformed with a portion of the earthen material contained therein;

a second container, formed of semipermeable material mutually conformed with a portion of the earthen material contained therein and stacked to be supported by the first container;

a retaining wall; and a first structural member engaging at least one of the first container and second container and extending to engage the retaining wall.

9. The retaining wall reinforcement of claim 8, where the first structural member transfers at least a portion of the outwardly directed loads imposed on the retaining wall to the first container.

10. The retaining wall reinforcement of claim 9, further comprising:

the first structural member extending from between the first and second containers to engage the retaining wall;

the first and second containers comprising geotextile tubes; and the earthen material comprising particles sized to pass through a number two hundred sieve and at a concentration of at least thirty percent by weight.

11. The retaining wall reinforcement of claim 10, further comprising a first drain layer positioned below the first container.

12. The retaining wall reinforcement of claim 11, further comprising a second drain layer positioned between the first and second containers.

13. The retaining wall reinforcement of claim 12, further comprising a third container formed of semipermeable material, conformally containing a portion of the earthen material, and stacked to be supported by the second container.

14. The retaining wall reinforcement of claim 13, farther comprising a second structural member extending from between the second and third containers to engage the retaining wall and transfer at least a portion of the outward directed loads imposed on the retaining wall to the second and third containers.

15. The retaining wall reinforcement of claim 8, wherein:

the first and second containers each comprise geotextile tubes;

the first structural member transfers at least a portion of the outward directed loads imposed on the retaining wall to the first and second containers; and the first structural member is selected from the group consisting of a woven geotextile; non-woven geotextile; homogeneous, uniaxial, geosynthetic grid; homogeneous, biaxial, geosynthetic grid; and heterogeneous, geosynthetic grid.

16. The retaining wall reinforcement of claim 8, wherein the structural member comprises one of a geosynthetic grid and a geotextile providing a series of interconnected voids between the first and second containers.

17. A method comprising:

excavating a foundation;

positioning a first geotextile tube over the foundation;

filling the first geotextile tube with earthen material comprising particles sized to pass through a number two hundred sieve and at a concentration of at least thirty percent by weight;

positioning a geosynthetic grid over the first geotextile tube;

positioning a second geotextile tube over the geosynthetic grid;

filling the second geotextile tube with earthen material comprising, at least thirty percent by weight, particles sized to pass through a number two hundred sieve;

erecting a retaining wall; and securing the retailing wall to the geosynthetic grid.

18. The method of claim 17, further comprising backfilling behind the retaining wall and around the first and second geotextile tubes with earthen material comprising, in a concentration of less than thirty percent by weight, particles sized to pass through a number two hundred sieve.

19. The method of claim 18, further comprising positioning a drain layer over the foundation before positioning the first geotextile tube.

20. The method of claim 19, further comprising positioning a geosynthetic drain layer between the first and second geotextile tubes and draining water therethrough from the earthen material.

* * * * *